US005522372A

United States Patent [19]

Gerstikov

[11] Patent Number: 5,522,372

[45] Date of Patent: Jun. 4, 1996

[54] BALL THROWING BAT

[76] Inventor: Daniel G. Gerstikov, 310 Arballo Dr. Apt. 1L, San Francisco, Calif. 94132

[21] Appl. No.: 415,423

[22] Filed: Apr. 3, 1995

[51] Int. Cl.[6] ..... A63B 65/12

[52] U.S. Cl. ..... 124/5; 273/72 R; 273/317

[58] Field of Search ..... 273/317, 26 B, 273/72 R; 124/4, 5

[56] References Cited

U.S. PATENT DOCUMENTS

| | | | |
|---|---|---|---|
| 3,115,129 | 12/1963 | Merriman | 124/5 |
| 3,120,387 | 2/1964 | Weinstein | 273/72 R |
| 3,496,924 | 2/1970 | Miller | 124/5 |
| 3,591,180 | 7/1971 | Lafon, Sr. | 124/5 X |

*Primary Examiner*—William H. Grieb
*Attorney, Agent, or Firm*—Goldstein & Associates

[57] ABSTRACT

A ball throwing bat comprising an upper portion, a lower portion, and a middle portion that is located between the upper and lower portions, the upper portion being cylindrical and having a larger diameter than the lower portion, which is also cylindrical. The middle portion tapers and joins the upper portion to the lower portion. The lower portion is used to grasp and swing the ball throwing bat. The upper portion has a bore that extends down into the ball throwing bat. The diameter of the bore is selected to have a sufficient size to accommodate the ball or ball-like object to be thrown. The ball is ejected from the bore by swinging the bat.

4 Claims, 3 Drawing Sheets

BALL THROWING BAT

BACKGROUND OF THE INVENTION

1. FIELD OF THE INVENTION

This invention relates to devices used for recreational or competitive sport games. More particularly, the present invention relates to devices used to throw or hurl a ball or ball like object.

2. BACKGROUND OF RELATED ART

There have been numerous recreational and sport games devised which involve the use of a ball, or ball-like object. (A reference to any generic ball, should, from this point forward be understood to mean a ball or ball-like object. ) Many of these games can be played with a single participant, while others are played with a small or large group of participants. Often these games can involve some kind of implement or device which is used in conjunction with the ball. Examples of games involving both a ball and a manually operated implement include golf, tennis, and lacrosse. The inclusion of an accessory device in these games generally allows the operator of the device to greatly increase the distance a ball can be driven, hurled or moved. For example, the use of a golf club or a baseball bat can greatly increase the distance that an individual can move a ball. (The use of the term move will be used interchangeably with, and should be understood to be equivalent to any of the following terms: hit, drive, throw, hurl, etc.)

Accessory devices come in a variety of shapes and sizes, and frequently require the operator to develop a certain level of skill to properly and consistently use them. An individual familiar with the art related to such devices would understand the large variety of ball moving devices that are established by the prior art.

One can distinguish the devices discussed above, which are used solely to move a ball a distance, from a second group of devices which can be used to move as well as catch a ball. A common example of a device used to move and retrieve a ball is a lacrosse stick. There are many others available in the prior art. For example, U.S. Pat. No. 5,290,039 issued to Cornelio, as well as U.S. Pat. No. 4,302,017 issued to Huqueriza relate to devices of this nature. The Cornelio patent is for a ball throwing and catching scoop. This device is held with a single hand and has an open, scoop-like design. The Huqueriza patent is for a device which is shaped somewhat like a cylinder with the bottom end capped and the top end partially cut away on an angle. The angled opening in the Huqueriza design could also be described as scoop-like in shape. The Huqueriza device is also held in one hand and operated manually. Both the Cornelio and the Huqueriza devices, as well as many others defined in the art, are designed and intended to be used to both throw and catch a ball, and are manually operated with one hand. These dual function devices are distinguishable from devices used to simply hurl or move a ball in both form and function.

In addition to the examples given above, the prior art defines other devices that are used to move a ball with no provision to catch a hurled or driven ball. It can be noted that these devices are not nearly as common as the throwing and catching devices discussed. One example of a ball moving device in the prior art is found in U.S. Pat. No. 4,892, 081 issued to Moörmann. This device uses compressed air to move a ball. Although operated with two hands, these types of devices are fundamentally different from the present invention in design, operation and purpose.

The present invention is directed to a device that is designed to hurl a ball with no provision provided for catching a thrown ball. The invention can be shaped much like an ordinary baseball bat, but can be constructed with a variety of exterior shapes. Unlike other ball throwing devices found in the art, the baseball bat-like shape of the present invention allows it to be used to both throw and hit a ball. The invention is typically operated with both hands using a swinging motion much like the motion used when swinging an ordinary baseball bat.

Accordingly, a main object of the invention is to provide a new and improved device which can be used to hurl a ball or ball like device. The present invention is distinguishable from the prior art in its simple construction and relative ease of operation. Further, most devices found in the prior art are operated with only one hand. Finally, the vast majority of prior art devices are used to both hurl and catch a ball. To this end, they are designed specifically with this 'dual function' in mind.

Another object of the invention is to provide a means to throw a ball like object while reducing the possibility of injury that can result by a repetitive overhand and side arm throwing motion. It is well known by those in the medical profession that throwing a ball like object with can lead to injuries of the shoulder and arm. A common example of one such injury is the rotator cuff injury. This injury is the direct result of an individual repeatedly hurling a ball with a hard throwing motion.

It is still another object of the invention to allow the operator of the invention a means to throw a ball like object a great distance with a simple, easy to use motion.

SUMMARY OF THE INVENTION

In accordance with the invention, the preferred embodiments described provide for a ball throwing bat which is used to hurl a ball like object. The device includes an upper portion which is substantially cylindrical in shape. A middle portion is connected to the bottom of the upper portion. The middle portion provides for a transition from the diameter of the upper portion to a lower portion. The lower portion, which is also elongated and substantially cylindrical in shape, is joined to the bottom of the middle portion. This lower portion is used as a handle to manually grip the ball throwing bat to allow the operator to swing the invention. The lower portion is of a reduced diameter than that of the upper portion. A knob formed at the bottom of the lower portion having a diameter larger than the diameter of the lower portion prevents the invention from inadvertently slipping out of an operators hands. The invention further includes a bore extending into the bat at the top end of the upper portion and continuing down into the bat along the length of the upper portion. The bore is appropriately sized to accept a ball like object.

BRIEF DESCRIPTION OF THE DRAWINGS

In the drawings, like elements are assigned by like reference numerals. The drawings are briefly described as follows.

DETAILED DESCRIPTION OF THE INVENTION

Figure 1:
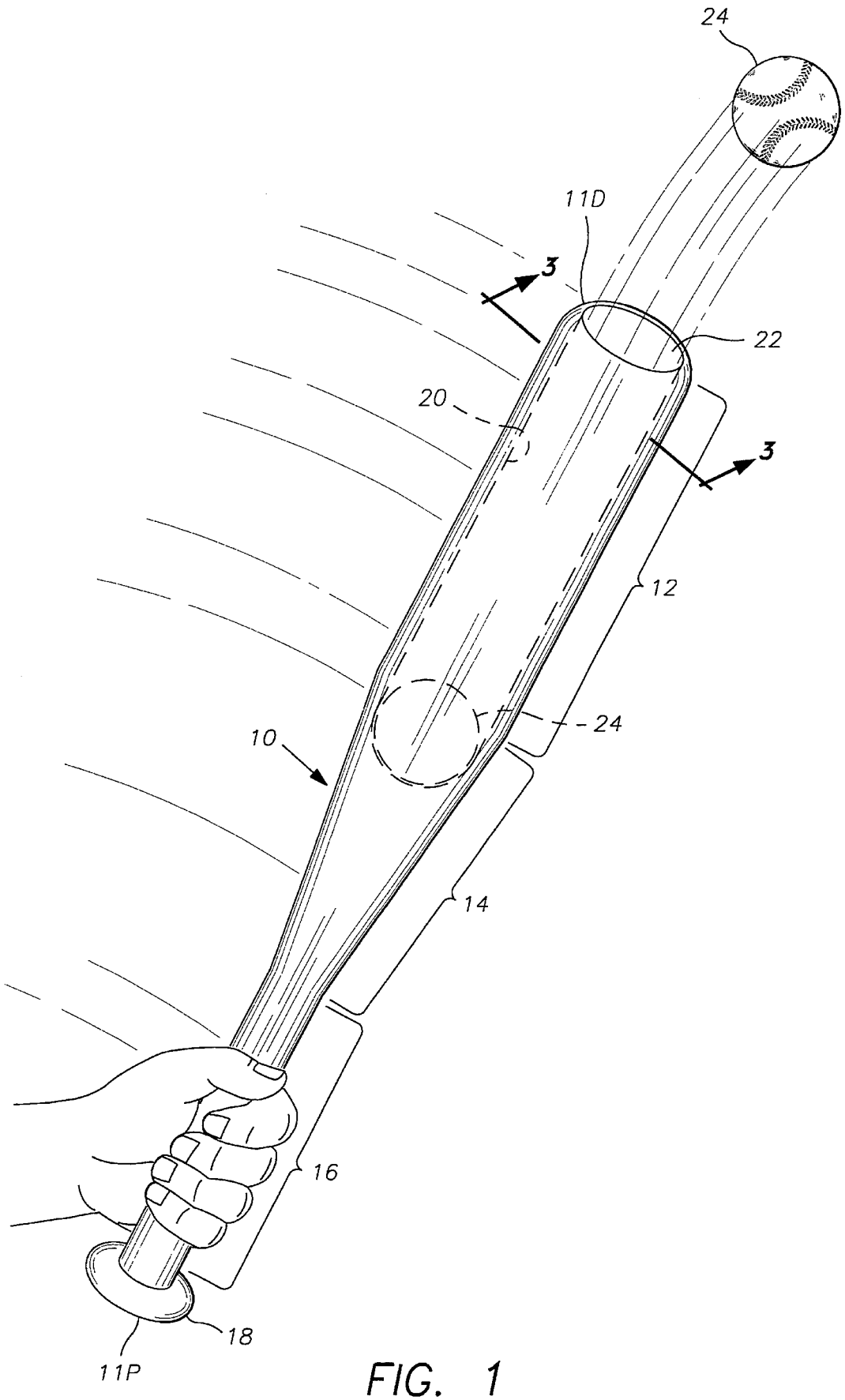
FIG. 1 illustrates an embodiment of the invention and a motion used to manually operate the invention.

Referring to FIG. 1, there is illustrated an embodiment of the present invention. The ball throwing bat 10 comprises an upper portion 12, a middle portion 14, a lower portion 16 and a knob portion 18. The ball throwing bat 10 also has a proximal end lip and a distal end 11D. The upper portion 12 is substantially cylindrical in shape and located at the distal end lid of the ball throwing bat 10. The upper portion 12, as shown in this embodiment, is the longest section of the ball throwing bat 10, and also has the largest diameter. The middle portion 14 is located between the upper portion 12 and the lower portion 16, and narrows from the upper portion 12, towards the proximal end lip of the ball throwing bat 10 until the diameter of the middle portion 14 approaches the diameter of the lower portion 16. The lower portion 16 of the ball throwing bat 10 is substantially similar to the handle of a typical baseball bat, and is used to grasp the ball throwing bat 10. A knob 18 is located at the proximal end 11P of the ball throwing bat 10. The knob 18 is of sufficient size and diameter to prevent the ball throwing bat 10 from slipping out of a hand of a person manually grasping and swinging the ball throwing bat 10. The lower portion 16 has the smallest diameter when compared to the upper portion 12, middle portion 14, and the knob 18.

It is important to note that all four portions of the throwing bat 10 illustrated in FIG. 1, namely the upper portion 12, middle portion 14, lower portion 16, and knob 18 can be varied to accommodate different combinations of lengths and diameters. For example, the length of the middle portion 14 can be longer if the taper from the upper portion 12 to the lower portion 16 is more gradual. Similarly, the knob 18 can be of various sizes.

FIG. 1 of the first embodiment of the ball throwing bat 10 also illustrates a cylindrical bore 20 beginning at the distal end lid end of the upper portion 12. The bore 20 extends through the upper portion 12 and partially enters the middle portion 14. The bore 20 creates an opening 22 at the distal end lid of the upper portion 12 of the ball throwing bat 10. A ball 24 is to be dropped into the bore 20 at the opening 22 of the upper portion 12. Accordingly, the diameter of said bore 20 and of said opening 22 should be of sufficient size to accept the ball 24. The ball 24 can be subsequently hurled or ejected from the ball throwing bat 10 by an appropriate swinging motion.

It is important to note that the bore 20 can be shorter or longer than the bore illustrated in FIG. 1. For example, the depth of the bore 20 may be selected so that the bore 20 does not enter the middle portion 14 at all. Conversely, the bore 20 may be deeper than shown in Fig.1 and thereby further extend into the middle portion 14 than is illustrated. Finally, the bore 20 as shown may or may not be centered within the diameter of the upper portion 12 of the ball throwing bat 10. That is, the bore 20 need not be concentric with the diameter of the upper portion 12.

Figure 2:
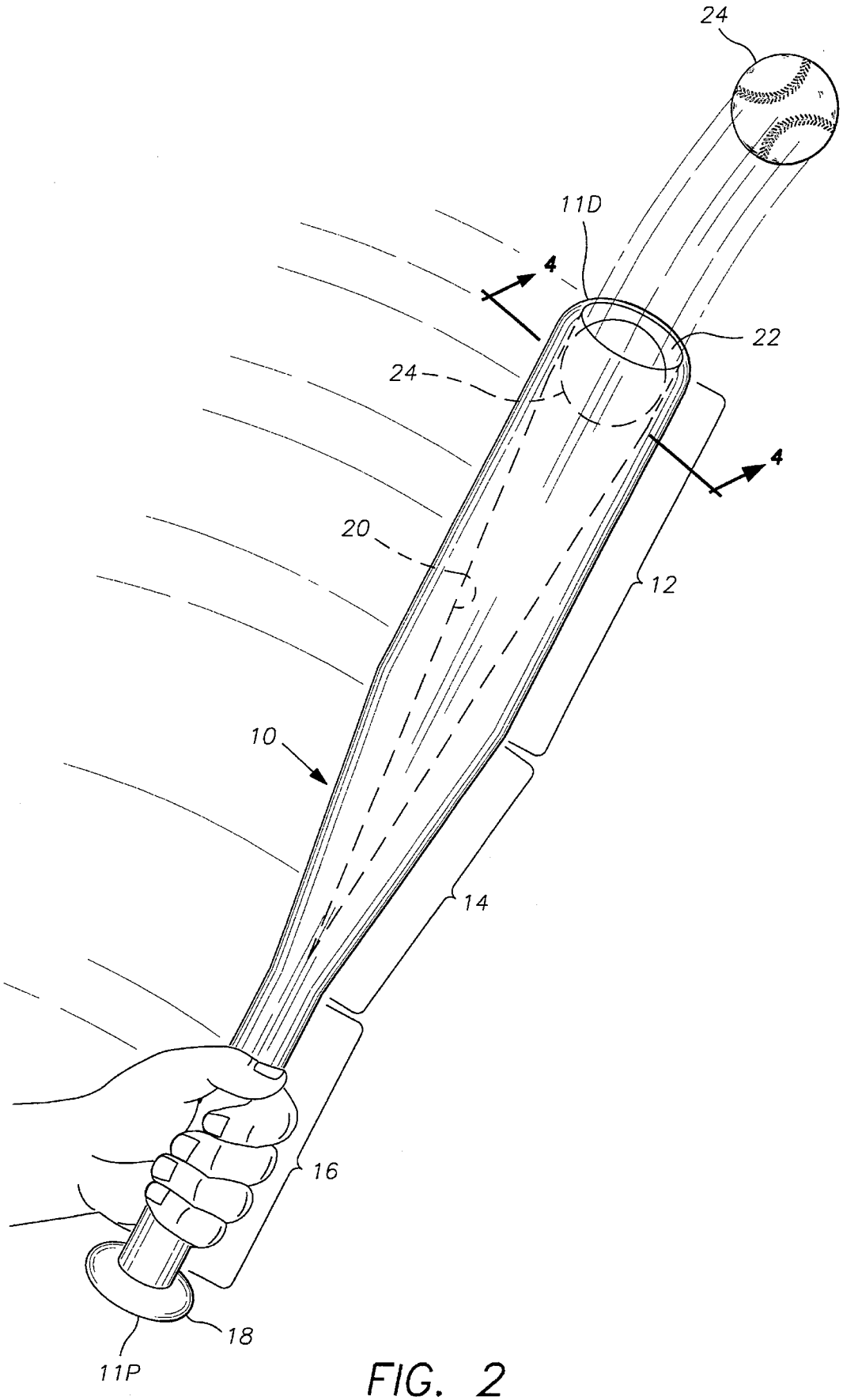
FIG. 2 shows a second embodiment of the invention along with a motion used for operation.

Referring now to FIG. 2, there is illustrated another embodiment of the ball throwing bat 10. Again shown are the four main sections of the ball throwing bat 10 including the upper portion 12, the middle portion 14, the lower portion 16 and the knob 18. One of the main distinguishing features of this embodiment is that the bore 20 is conical in shape. The bore 20 begins at the distal end lid of the upper portion 12 and extends down the length of the ball throwing bat 10 through the upper portion 12. The bore 20 continues and extends into the middle portion 14 of the ball throwing bat 10. It should be noted that although the length and taper of the bore 20 can be varied, the initial diameter of the bore 20, as well as the diameter of the opening 22, must be large enough to accept the ball 24 and allow it to be placed within the throwing bat 10.

It is also important to note that tile lengths of all four portions of the ball throwing bat 10 illustrated in FIG. 2 can be varied to provide different combinations of diameters of the four portions discussed. For example, the length of the middle portion 14 can be shorter if the rate of taper from the upper portion 12 to the lower portion 16 is increased. Similarly, the lower portion 16 can be longer or shorter than illustrated in FIG. 2. Further, it should be clear that although the bore 20, as shown in FIG. 2, has an initial diameter close to the outer diameter of the upper portion 12 of the bat, this need not be the case for other possible embodiments. Thus, a larger outer diameter of the upper portion 12 can be employed with the bore 20 having a substantially smaller diameter than the upper portion 12. Also, as was previously mentioned regarding the embodiment illustrated in FIG. 1, the bore 20 can be shorter or longer than illustrated in FIG. 2. Thus, the bore 20 may have a depth that does not enter the middle portion 14 at all, or conversely, the bore 20 may extend through the middle portion 14 and into the lower portion 16. Lastly, the bore 20 as shown may or may not be centered within the diameter of the upper portion 12 of the throwing bat 10. That is, the initial diameter of the bore 20 need not be concentric with the diameter of the upper portion 12.

Figure 3:
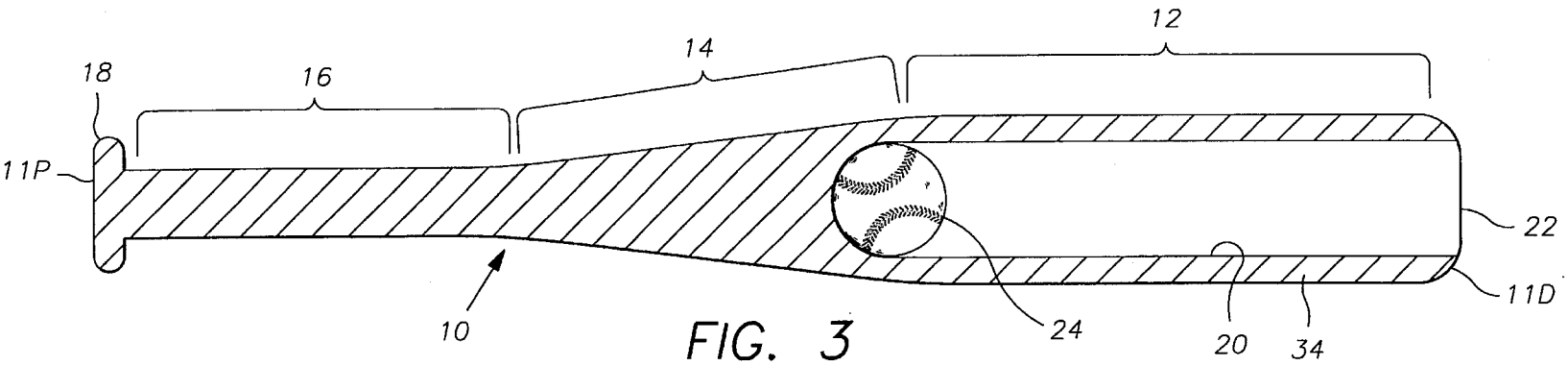
FIG. 3 provides a cross section view, taken on line 3—3, of the embodiment shown in FIG. 1.

With reference now to FIG. 3, there is presented a cross-section view taken on line 3—3 in FIG. 1. of the ball throwing bat 10. Clearly shown are the upper portion 12, the middle portion 14, the lower portion 16, and the knob 18. Also illustrated in FIG. 3 is the bore 20 that begins at the distal end 11D of the ball throwing bat 10, extends through the upper portion. 16, and continues into the middle portion 14. FIG. 3 further illustrates a cavity wall 34 formed by the outer diameter of the upper portion 12 and the bore 20. The thickness of the cavity wall 34 can vary with the respective diameters of the upper portion 12 and bore 20.

The opening 22 of the ball throwing bat 10 could be widened or rounded outwardly. This modification would eliminate a possibly sharp edge around the opening 22, and also may allow for an easier insertion of the ball 24 into the throwing bat 10.

Figure 4:
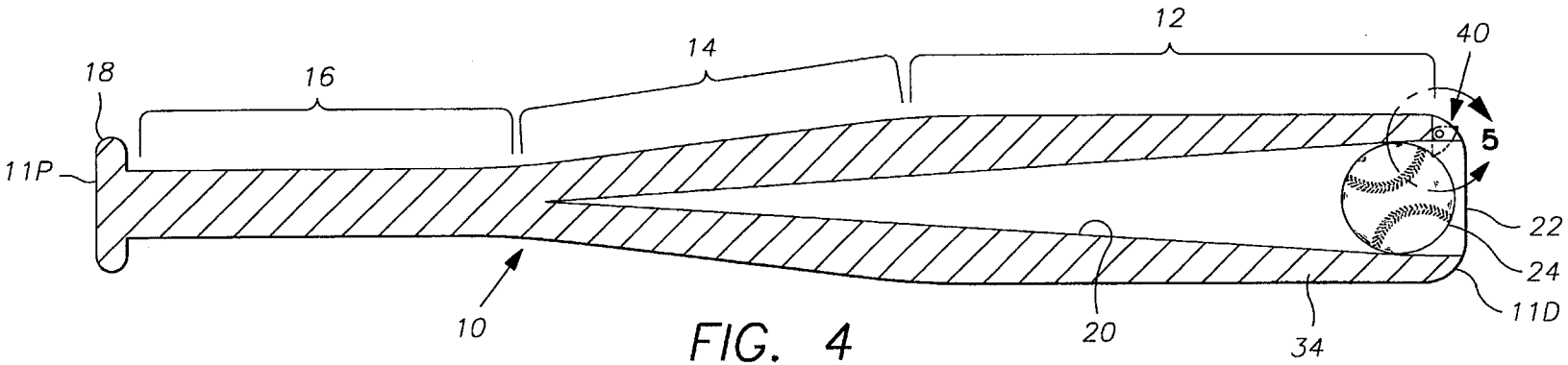
FIG. 4 depicts a cross section view, taken on line 4—4 of the embodiment shown in FIG. 2.

Referring now to FIG. 4, there is illustrated a cross section view of the ball throwing bat 10 taken on line 4—4 of FIG. 2. Clearly shown is the upper portion 12, the middle portion 14, the lower portion 16, and the knob 18 as presented and discussed with FIG. 2. Also illustrated in FIG. 4 is the bore 20 that begins at the distal end lid of the ball throwing bat 10 and extends through the upper portion 12 and continues down into and possibly through the middle portion 14, the bore is fully enclosed up to the distal end.

Also illustrated in FIG. 4. is a stopper 40 that is provided to yieldably engage the ball 24. The stopper 40 is movable from a first position, allowing the ball 24 to be placed or dropped into the bore 20, to a second position, which holds and restrains the ball 24 within the bore 20. The ball 24 is restrained until enough force has been generated by an appropriate swinging motion of the ball throwing bat 10 so as to cause the stopper 40 to be moved from the second position to the first position and resulting in the ejection of the ball 24 out of the bore 20 at the opening 22, resulting in the hurling of the ball 24.

Figure 5:
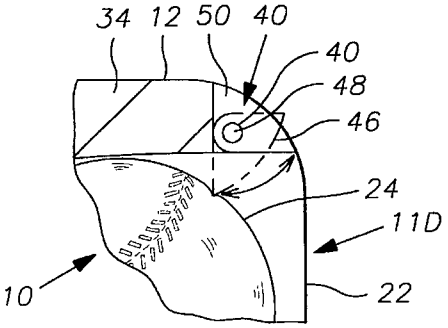
FIG. 5 is an enlarged sectional view of the stopper, taken on circular arrow 5 of FIG. 4.

Turning now to FIG. 5, there is provided an enlarged sectional view of the embodiment of the stopper 40 given in FIG. 4. The stopper 40 includes a stopper tab 46, a stopper pivot pin 48, and a stopper tab slot 50. The stopper tab slot 50 is oriented vertically with respect to the length of the ball throwing bat 10 and cuts radially through the cavity wall 34 of the upper portion 12 at the distal end 11D of the ball throwing bat 10, adjacent to the opening 22. The stopper tab 46, having a thickness close to the width of the stopper tab slot 50, is substantially like an isosceles triangle in shape, having a hole 52 located near the angle formed by the two equal length sides. The stopper tab 46 fits snugly into the stopper tab slot 50. The stopper tab 46 is mounted on the stopper pivot pin 48 which is mounted transversely to the length of the ball throwing bat 10, and extends through the cavity wall 34 and through the hole 52 in the stopper tab 46.

The stopper tab 46 pivots between a first position, which allows the ball 24 to be placed or dropped into the bore 20, and a second position, where the stopper tab 46 protrudes through the stopper tab slot 50 into the bore 20, restraining the ball 24.

The rotation of the stopper tab 46 about the stopper pivot pin 48 within the stopper tab slot 50 allows the stopper tab 46 to be oriented in the first open position so that the ball 24 can be dropped into the bore 20 of the ball throwing bat 10. Then, the stopper tab 46 may be pivoted and placed in the second position, yieldably restraining the ball 24 inside the bore 20 of the ball throwing bat 10. Subsequently, a suitable swinging motion of sufficient force will cause the stopper tab 46 to be forced back into the stopper tab slot 50, hence allowing the ball 24 to be ejected from the bore 20, and in the process repositioning the stopper tab 46 in the original first position, ready to accept the ball 24.

There are a number of approaches that can be employed to bias the stopper tab 46 in the second ball restraining position. One such approach will be briefly discussed. The simplest approach would involve the use of friction. By varying the respective thickness of the stopper tab slot 50 and the stopper tab 46, an acceptable level of friction may be created so that the stopper tab 46 will maintain the ball 24 in the bore 20 until a sufficient ejection force has been generated when the ball throwing bat 10 is swung to force the stopper tab 46 completely into the stopper tab slot 50. To this end, the use of a threaded stopper pivot pin 48 may be preferred with this biasing approach. The threaded stopper pin 48 could be tightened to provide the desired amount of friction.

It is significant to note that the invention embodied in the forms provided in the accompanying drawings and described in the foregoing text is intended to be illustrative only. Variations are contemplated as being a part of the present invention, limited only by the spirit and scope of the stated claims. For example, there are many ways that the stopper 40 could be implemented. Also, the lower portion 16 could be knurled to allow an improved grip in the event the hands of the operator are wet or slippery. Also, a variety or combination of cylindrical and conical bores may be employed in a particular embodiment of the present invention.

What is claimed is:

1. A ball throwing bat, for hurling a ball like object, having a proximal end and a distal end, comprising:

an upper portion, located at the distal end of the ball throwing bat;

a lower portion, said lower portion having a diameter less than the diameter of said upper portion, and said lower portion being used to manually grasp the ball throwing bat;

a middle portion, located between said upper portion and said lower portion, providing tapered transition joining said upper portion to said lower portion;

a knob, formed at the proximal end of said lower portion, having a diameter larger than the diameter of said lower portion;

a bore extending into the ball throwing bat at the distal end of said upper portion, said bore sized to accept the ball like object, said bore extending fully through the upper portion, and the bore fully enclosed up to the distal end of the bat; and a stopper mounted at the distal end of the ball throwing bat, and extending into the bore of said ball throwing bat, said stopper being operable between a first position, where said stopper allows the ball like object to be placed within the bore, and a second position where said stopper restrains the ball in the bore such that when the ball throwing bat is swung, the ball exerts a force upon said stopper moving said stopper from the second position to the first position where said stopper releases the ball, wherein said stopper comprises a stopper tab having a substantially triangular shape, a stopper pivot pin, the stopper pivot pin mounted to the distal end of the upper portion transverse to the length of the bat, where the stopper tab pivots on the stopper pin between the first position and the second position.

2. The ball throwing bat as in claim 1, wherein said bore extends through the length of said upper portion and into said middle portion of the ball throwing bat.

3. The ball throwing bat as in claim 2, wherein said bore is cylindrical in shape.

4. The ball throwing bat as in claim 1, wherein said bore is conical in shape.

* * * * *